US005342220A

United States Patent [19]

Kodama

[11] Patent Number: 5,342,220

[45] Date of Patent: Aug. 30, 1994

[54] ELECTRICAL CONNECTOR WITH ELECTROSTATIC DISCHARGE PROTECTION

[75] Inventor: Hiromitsu Kodama, Yokohama, Japan

[73] Assignee: The Whitaker Corporation, Wilmington, Del.

[21] Appl. No.: 900,048

[22] Filed: Jun. 17, 1992

[30] Foreign Application Priority Data

Jul. 3, 1991 [JP] Japan ..... 3-188327

[51] Int. Cl.[5] ..... H01R 13/648

[52] U.S. Cl. ..... 439/607; 439/108

[58] Field of Search ..... 439/92, 101, 108, 181, 439/607-610

[56] References Cited

U.S. PATENT DOCUMENTS 4,568,133 2/1986 Amano et al. ..... 439/181 X
4,711,506 12/1987 Tanaka ..... 439/181 X
4,789,847 12/1988 Sakamoto et al. ..... 439/607 X
4,824,377 4/1989 De Burro ..... 439/607 X
5,066,240 11/1991 Verdun ..... 439/181

*Primary Examiner*—Khiem Nguyen
*Attorney, Agent, or Firm*—Timothy J. Aberle

[57] ABSTRACT

An electrical connector (10) of a type utilized to connect components that are sensitive to electrostatic discharge voltage transients includes a housing (20) having a projecting, unprotected forward portion (23) and a front face having slots (*27a, 27b*) therein and containing contacts (30) having ends (31) in such forward portion proximate to the slots and positioned to be engaged by contacts of a mating connector inserted within the housing. The housing (20) includes a grounding shield (40) that surrounds the forward portion and covers the face of the housing with slits (*44a, 44b*) extending around the housing slots to define a path to ground shorter than the path from the exterior of the housing to the contact ends (31) to assure that an electrostatic discharge from a source exterior to the connector is grounded.

5 Claims, 2 Drawing Sheets

ELECTRICAL CONNECTOR WITH ELECTROSTATIC DISCHARGE PROTECTION

FIELD OF THE INVENTION

This invention relates to an electrical connector having electrostatic discharge protection.

BACKGROUND OF THE INVENTION

The miniaturization of electronic components found in such devices as integrated circuits finds extremely small conductive traces spaced on close centers to make such components vulnerable to voltage spikes or transients. These transients come in many forms, including a common form caused by an electrostatic buildup of charge on operators or equipment. For example, in dry climates, an operator may carry up to 15,000 volts in static charge, resulting in electrostatic discharge from the operator in touching, for example, a keyboard of a computer; or a connector or some part of equipment exposed to such touch. A resulting voltage spike may jump to conductive elements and find its way onto the circuits of a board to destroy or damage sensitive components contained thereon. One solution to the problem has been to provide filters between those components that can receive an electrostatic discharge and those components that are sensitive to electrical overstress. In such cases, electrostatic discharge spikes are filtered to ground or be absorbed by filters before causing damage. The use of filters is an added cost to components. Additionally, it is a cost that requires frequently a change in design of components to accommodate for the additional volume of the filters, volume in connectors or on expensive printed circuit boards being required in any event.

Accordingly, it is an object of the present invention to provide electrostatic discharge protection for connectors, or portions of connectors accessible to operators or to equipments carrying static voltage charges. It is a further object to provide an electrostatic discharge protection for a connector without the use of filters. It is still a further object of the invention to provide electrostatic discharge protection to connectors having multiple rows of contacts, and it is a final object to provide an improved construction for protecting against electrostatic discharge, grounding and shielding electrical connectors and signal paths contained therein.

SUMMARY OF THE INVENTION

An electrical connector is provided that includes a plastic housing carrying multiple contacts arranged in rows within the housing to receive contacts of a mating connector inserted into mating engagement with the contacts of the connector. The connector housing includes a forward portion carrying the contacts that are mated, the forward portion projecting outwardly from a housing or cabinet. The housing includes a rearward portion that is attached to a circuit, such as a printed circuit board, carrying post portions of the contacts soldered to or otherwise terminated to the board. Signals passed through the connector to the board and from the board through the connector establish the input/output signal paths for functional devices such as a computer, communication equipment, or the like. It is through these paths that voltage transients caused by electrostatic discharge can occur, voltage spikes traveling to contacts on the exposed side of the connector, along such contacts and into a board of use to cause overstress of sensitive and delicate components thereon. The invention contemplates a use with connectors having multiple rows, connectors having slots in the housings with the contacts necessarily proximate such slots. Heretofore, the finger of an operator or a tool, such as a screwdriver or a pen, could allow the discharge of a static charge through the slot onto the contact, even though the finger or tool did not actually touch a contact, its proximity to the electrical path formed by the contact resulting in a spark with the voltage transient jumping to the contact to cause damage. The invention connector includes a thin, conductive covering over the front portion of the connector housing that is suitably grounded to carry any electrostatic discharge from an object proximate to or touching the forward portion of the connector. The invention utilizes a thin metal cover in the form of a stamping or drawing that surrounds the multiple slots of the connector along the length of the slots and at the ends and between such slots. The metallic element is so formed that the distance from an object proximate the front end of a connector to a contact within the connector is longer than the distance from such object to the metallic element, assuring that discharge will be to the grounded metallic element. The invention includes the embodiments accommodating multiple slots such as two or three or more in connectors.

BRIEF DESCRIPTION OF THE DRAWINGS

The invention will now be described by way of example with reference to the accompanying drawings in which.

DETAILED DESCRIPTION OF THE INVENTION

Figure 1:
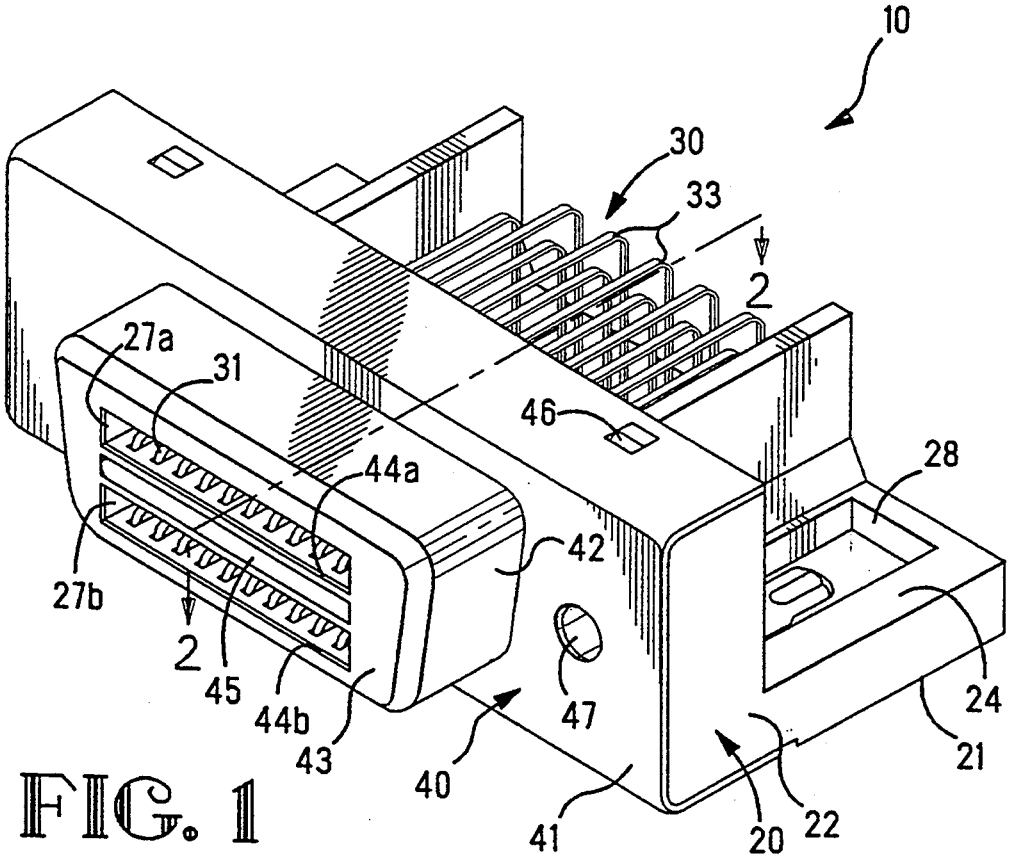
FIG. 1 is a perspective view of a connector in accordance with the invention.
Figure 2:
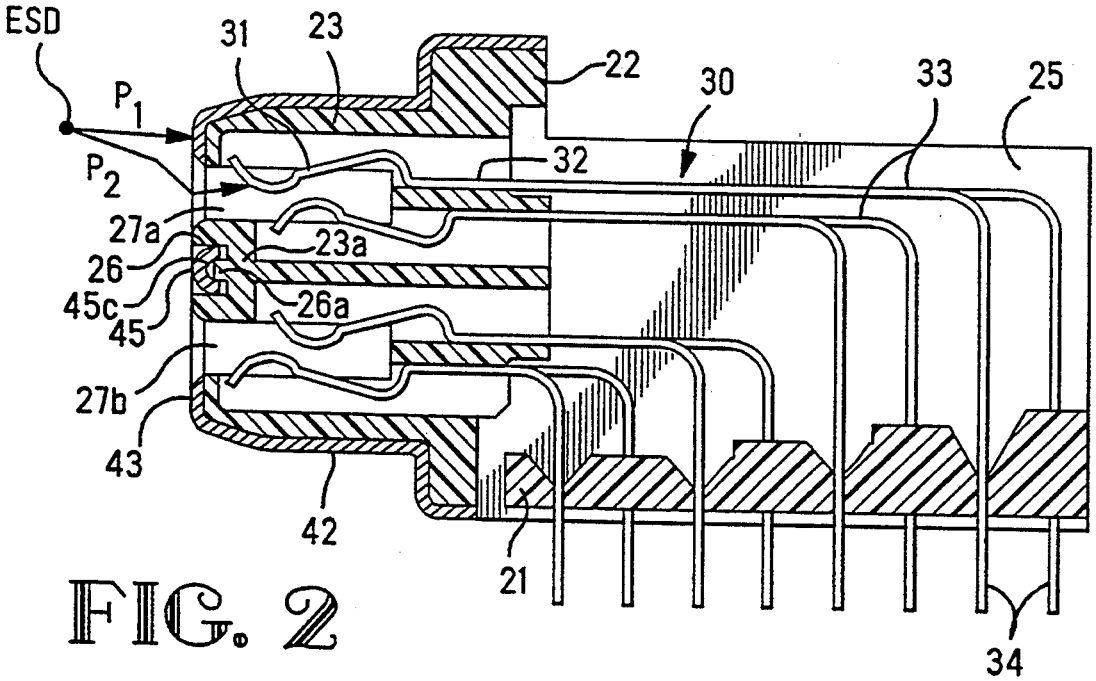
FIG. 2 is a side elevational view, partially sectioned, taken along lines 2—2 of FIG. 1.

Referring now to FIG. 1, a connector 10, in accordance with the invention, may be seen to have a plastic and insulating housing 20 having a grounding shield 40 and contacts 30 carried by such housing. The shield 40 is connected to grounding paths by suitable means, not shown, such as the ground circuit on a board with which the connector is used. The rear portion 21 will typically be recessed within a cabinet or the like with portion 23 projecting outwardly for access. The housing 20 includes rear portion 21 that extends over circuit board, not shown, upon which the connector is mounted. As can be seen in FIGS. 1 and 2, housing 20 includes a further, upstanding portion 22 and a projecting portion 23. The projecting portion 23 includes a pair of slots **27*a* and 27*b* that extend across the front face of the projecting portion. Between these slots, as shown in FIG. 2, is a groove 26 that extends across the front face of the projecting portion and interior passages that carry the front contact ends 31 of contacts 30. The contacts 30 include portions 32 that mount the contacts in the housing, and portions 33 that form right angle bends to end in post portions 34 that are inserted within holes of a printed circuit board, not shown, and soldered to conductive traces thereon to interconnect the contacts to circuit components. As can be seen in FIG. 2, the contacts include spring finger constructions that are displaced upon the insertion of a mating contact, pin post or blade extended within the slots 27***a* and 27*b* to engage the contact ends 31 proximate to such slots. As can be seen in FIG. 2, an electrostatic discharge source ESD is shown relative to the front face of the connector with discharge path lengths $P_1$ and $P_2$ shown relative to the connector front face and the end 31 of a contact 30. As can be seen, the path length $P_1$ to the face 43 of shielding ground 40 is less than $P_2$, to the end 31 of contact 30. If ESD were moved downwardly, these path lengths would be altered to a point such that they were the same or $P_2$ less than $P_1$; but in such case, the path length to the cross piece 45 of shield 40 would assure a discharge to the shielding ground rather than to the end of a contact. The cross-piece 45 includes a bent portion 45*c* which engages a projection 26*a* formed on a generally E-shaped portion 23*a* of the housing 23.

Figure 3:
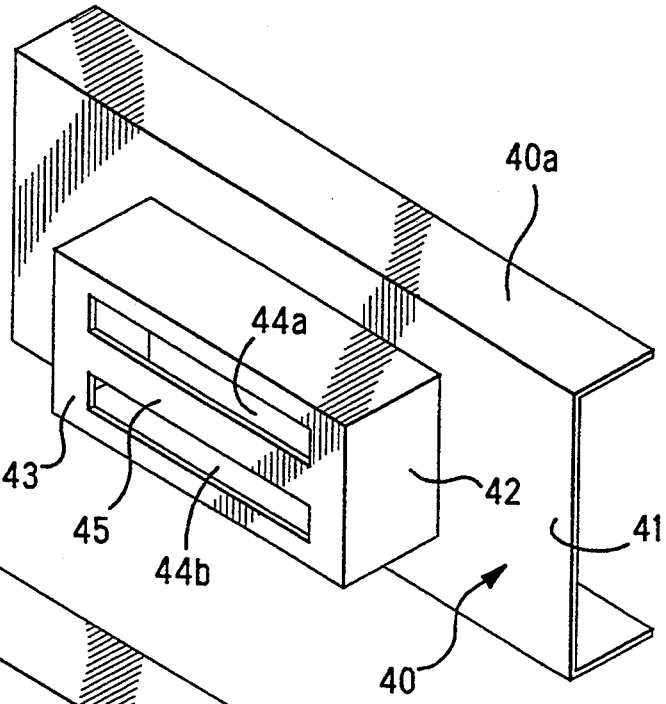
FIG. 3 is a perspective view of one version of a shielding ground in accordance with the invention.

As can be seen in FIGS. 1, 2, and 3, the grounding shield 40 includes a front face 41 and a projecting portion 42 that extends outwardly therefrom to cover over the projecting portion 23 of housing 20. The portion 42 extends to define the face 43 with slits 44*a* and 44*b* extending across face 43 to allow access to the slots 27*a* and 27*b* and access to the contacts contained within the housing. Between slits 44*a* and 44*b* is a cross piece 45 that is formed to fit within the groove 26 of the housing and perform the function heretofore mentioned relative to electrostatic discharge from a source more or less centered on the connector front face.

As can be discerned, the invention contemplates apertures such as 46 that may be engaged by latch elements on the housing to latch the shielding ground 40 to the housing. Additionally, apertures 47 may be provided to receive fasteners that attach the connector to a face plate, panel, or facade or equipment, or alternatively, to receive fasteners that lock the connector 10 to a connector mated thereto. A mated connector would typically be connected to wires or cables from equipment served by the components on a printed circuit board associated with connector 10. Such mated connector would typically also have a metallic grounding shield surrounding the forward end of the connector and dimensioned to engage the grounding shield 40 proximate the portion 42 to preclude static built up from the connector, the cable, or on an operator's hand assembling the connectors discharging onto a contact within connector 10 to cause a problem.

Figure 4:
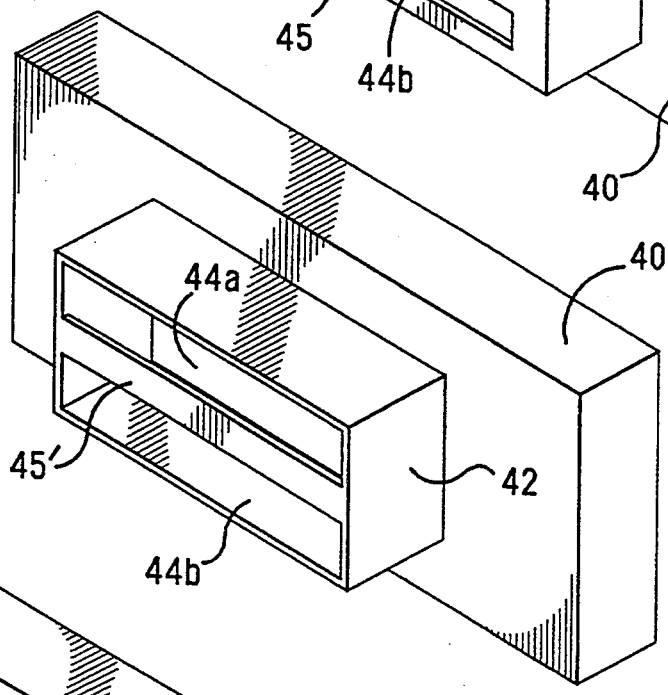
FIG. 4 is a perspective view of an alternative version of a shielding ground in accordance with the invention.
Figure 5:
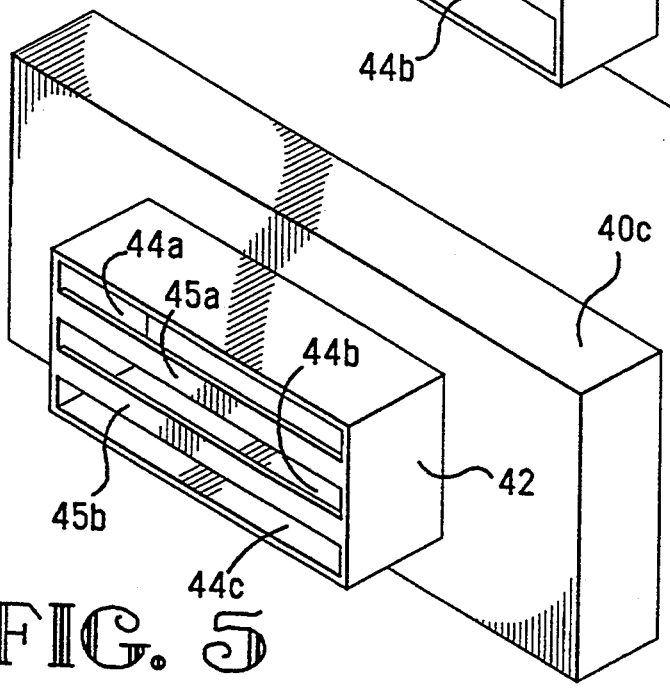
FIG. 5 is still a further perspective view of a further embodiment of a shielding ground in accordance with the invention.

FIG. 3 shows a version of the grounding shield, somewhat simplified, with a common enumeration except for the numeral 40*a* denominating the simplified version of the grounding shield. As can be discerned, the shield 40*a* includes rear portions that would fit over the connector housing and a forward portion 42 that would surround a forward portion of the housing, containing a face 43, slots 44*a* and 44*b* and a cross member 45. FIG. 4 shows a slightly different version in the form of a shield 40*b* wherein the rear portion is enclosed and the cross member 45' extends completely across the forward portion 42; to accommodate a slightly different type of connector but nevertheless provide electrostatic discharge protection to contacts contained within a housing within shield 40*b*. FIG. 5 shows a version of a grounding shield 40*c* containing three slits 44*a*, 44*b*, and 44*c* separated by members 45*a* and 45*b* to accommodate a connector having three slots in the housing and three rows of contacts.

As can be appreciated from the foregoing, the invention contemplates the provision of a grounding shield structure fitted over a connector to include slits therein defining conductive paths to ground that have surface edges invariably closer to the source of an electrostatic discharge than contacts contained within a housing and within such grounding shield. The invention contemplates a variety of different constructions, including one along the lines disclosed wherein the grounding shield is formed of thin metallic stock, stamped, formed or drawn, as well as grounding shields of similar geometric configuration.

I claim:

1. A shielded electrical connector, comprising:

a dielectric housing having slots extending along a front surface and toward a rear surface of said housing;

electrical contacts secured in said housing and having contact sections disposed along said slots spaced from said front surface; and a metal shield on said housing covering said front surface and having slits in communication with said slots whereby an area around the slits provides a path for an electrostatic charge to ground instead of to the contact sections, said dielectric housing further includes a transverse groove with a forwardly directed projection therein, and said metal shield includes a cross piece disposed in said groove and having an inner bent surface which at least partially encloses said projection.

2. A shielded electrical connector as claimed in claim 1, wherein said housing has a projecting portion and said metal shield covers said projecting portion including the front surface thereof.

3. A shielded electrical connector as claimed in claim 2, wherein a section of said projecting portion between said slots has a groove in which a cross piece of said metal shield is disposed.

4. A shielded electrical connector, comprising:

a dielectric housing having a front surface from which a projecting portion extends, said projecting portion having parallel slots extending thereacross and extending therewithin;

electrical contacts secured in said housing and having contact sections disposed along said slots spaced inwardly from a front end of said projecting portion; and a metal shield on said housing covering said front surface and said projecting portion including the front end thereof and having slits in communication with said slots, said dielectric housing further including a generally E-shaped portion disposed in a mid-section of said front end which engages a cross piece on the metal shield, the cross piece being located adjacent the slots.

5. A shielded electrical connector as claimed in claim 4, wherein a section of said front end of said projecting portion between said slots has a groove in which a cross piece of said metal shield is disposed.

* * * * *